US006476565B1

(12) United States Patent
Kaminski

(10) Patent No.: US 6,476,565 B1
(45) Date of Patent: Nov. 5, 2002

(54) REMOTE POWERED ELECTRODELESS LIGHT BULB

(76) Inventor: Michael Charles Kaminski, 702 650 Rd., Delta, CO (US) 81416

( * ) Notice: Subject to any disclaimer, the term of this patent is extended or adjusted under 35 U.S.C. 154(b) by 0 days.

(21) Appl. No.: 09/832,627

(22) Filed: Apr. 11, 2001

(51) Int. Cl.[7] ..... H05B 41/16

(52) U.S. Cl. ..... 315/248; 315/34; 315/185 S; 313/110; 313/484; 362/801; 362/806

(58) Field of Search ..... 315/248, 39, 34, 315/111.41, 111.51, 185 S; 313/110, 484; 362/801, 803, 806

(56) References Cited

U.S. PATENT DOCUMENTS

| | | | | | |
|---|---|---|---|---|---|
| 454,622 | A | * | 6/1891 | Tesla | |
| 455,069 | A | * | 6/1891 | Tesla | |
| 2,179,601 | A | * | 11/1939 | Smith | |
| 3,705,319 | A | * | 12/1972 | Goldie et al. | 313/54 |
| 3,860,854 | A | * | 1/1975 | Hollister | 315/248 |
| 4,427,922 | A | * | 1/1984 | Proud et al. | 315/248 |
| 4,675,577 | A | * | 6/1987 | Hanlet | 315/248 |
| 4,910,439 | A | * | 3/1990 | El-Hamamsy et al. | 315/248 |
| 5,191,460 | A | * | 3/1993 | Lapatovich | 359/154 |
| 5,866,991 | A | * | 2/1999 | Farkas et al. | 315/248 |
| 5,886,479 | A | * | 3/1999 | Kennedy et al. | 315/248 |
| 5,905,343 | A | * | 5/1999 | McCamant | 315/57 |
| 6,051,922 | A | * | 4/2000 | Schlejen et al. | 313/489 |

* cited by examiner

*Primary Examiner*—Don Wong
*Assistant Examiner*—Tuyet T. Vo
(74) *Attorney, Agent, or Firm*—Michael I Kroll

(57) ABSTRACT

The present invention 10 discloses a remote powered electrodeless light bulb 12 and an RF transmitter 14. The bulb 12 requires no electrical connection and will not burn out, can be submerged into water without causing electrocution, is safe and non toxic and has many uses. The bulb 12 may be of any size or shape, and is filled with inert argon gas and or other inert gases under vacuum. The transmitter 12 emits an RF field from a distance of 1 to 25 feet and comprises a variable frequency adjustment knob 16, an output power field adjustment knob 18 and a special effects transmitter knob 20 for changing the pulse/strobe rate. Also shown is a power source 22, a base 24, which may be made of metal, a chassis ground wire 26, an antenna 28, and a transmitter housing 30. Clear or colored glass or plastic 32 material of any shape or size form the wall of the bulb 12 and may be impregnated on its inner surface with fluorescent compound 34 and argon gas 36 and or multiple gases to produce color change at variable transmitter frequencies. A hook 38 for hanging the bulb 12 is also shown.

11 Claims, 8 Drawing Sheets

REMOTE POWERED ELECTRODELESS LIGHT BULB

BACKGROUND OF THE INVENTION

1. Field of the Invention

The present invention relates generally to light sources and more specifically to an electrodeless light source. The present invention is a remotely RF energized light source consisting of a variable frequency, variable power and a special effects transmitter and a glass or plastic medium that contains one or more inert gases capable of being excited by a RF field, causing the gas or gases to emit photons in the UV range which then energizes fluorescent compounds to produce visible light. The light source colors emitted, may be changed by mixing gases that emit a spectrum associated by its photon wave length and vary the transmitter frequency output. Special effects such as flashing, strobing or audio modulation are achieved by timing circuits and audio inputs from the transmitter. Power levels are controlled by the user via an external power level adjustment knob. Bulb modules are placed in proximity of the transmitter RF field from a distance of 1 foot to 25 feet. The range can be extended by a more powerful transmitter and/or a directional antenna or wave guide. The present invention complies with the FCC regulation part 15 title 47 radio frequency emissions.

2. Description of the Prior Art

There are other electrodeless light bulb devices designed to improve the discharge of light source. Typical of these is U.S. Pat. No. 454,622 issued to Tesla on Jun. 23, 1891.

Another patent was issued to Tesla on Jun. 30, 1891 as U.S. Pat. No. 455,069. Yet another U.S. Pat. No. 2,179,601 was issued to Smith on Nov. 14, 1939 and still yet another was issued on Jan. 14, 1975 to Hollister et. al as U.S. Pat. No. 3,860,854.

Another patent was issued to Proud et. al on Jan. 24, 1984 as U.S. Pat. No. 4,427,922. Another patent was issued to Hanlet et. al on Jun. 23, 1987 as U.S. Pat. No. 4,657,577. Another patent was issued to EL-Hamamsy et. al on Mar. 20, 1990 as U.S. Pat. No. 4,910,439. Another patent was issued to Kennedy et. al on Mar. 23, 1999 as U.S. Pat. No. 5,886,479. Another patent was issued to Farkas et. al on Feb. 2, 1999 as U.S. Pat. No. 5,866,991. Another patent was issued to McCamant on May 18, 1999 as U.S. Pat. No. 5,905,343. Another patent was issued to Schlejen on Apr. 18, 2000 as U.S. Pat. No. 6,051,922.

U.S. Pat. No. 454,622

Inventor: Nikola Tesla

Issued: Jun. 23, 1891

New and useful improvements in methods of an apparatus for electric lighting.

U.S. Pat. No. 455,069

Inventor: Nikola Tesla

Issued: Jun. 30, 1891

A new form of lamp for giving light by incandescence of carbon or other suitable refractory conductor produced by electrical energy.

U.S. Pat. No. 2,179,601

Inventor: C. G. Smith

Issued: Nov. 14, 1939

Relating to gaseous discharge devices. The object of the invention is the provision of such device in which the current flow is capable of being controlled by means of a space charge grid or a magnetic field in a manner analogous to the control of electron flow in high vacuum discharge devices.

U.S. Pat. No. 3,860,854

Inventor: Donald Hollister

Issued: Jan. 14, 1975

Method of generating an electrodeless plasma arc as a light source including confining a plasma forming gas within a suitable envelope pressurizing while confining the gas and applying radio frequency power exteriorly of the envelope so as to develop magnetically an induction field extending through the envelope and into the gas such that the gas is ionized as a plasma arc suspended within the envelope.

U.S. Pat. No. 4,427,922

Inventor: Joseph Proud

Issued: Jan. 24, 1984

A source of visible light including an electrodeless lamp containing a mercury halide. When the contents of the electrodeless lamp are excited by high frequency power, excited mercury (I) halide molecules emit visible light.

U.S. Pat. No. 4,910,439

Inventor: Spayed Arm EL-Hamamsy

Issued: Mar. 20,1990

A high intensity discharge electrodeless lamp having a segmented excitation coil and capacitor configuration offers minimum light obstruction and RF losses while providing maximum impedance matching and heat transfer from the coil to a heat sink.

U.S. Pat. No. 5,886,479

Inventor: Paul G. Kennedy

Issued: Mar. 23, 1999

A method and apparatus for exciting an electrodeless light bulb containing material including an inert gas and one or more chemical elements which generate a light emitting torus of plasma when excited by an RF signal and which includes two separate excitation coils oriented about the bulb so that the planes of each of the coils are mutually oriented 90 degrees with respect to each other, and wherein each of the coils are driven by respective RF excitation voltages having mutually different frequencies, for example, a difference of 4%, so as to excite the material enclosed within the bulb and cause a stirring action of the fill and effect a pulsating emission of light and rotation of the torus similar to that produced by physical rotation of the bulb itself.

U.S. Pat. No. 5,905,343

Inventor: Angus J. McCamant

Issued: May 18, 1999

An incandescent bulb having a looped filament within an evacuated bulb containing a gas mixture including a halogen employs magnetic means external to the bulb to provide inductive heating of the filament so that there are no connections passing through the bulb envelope. Alternative embodiments include a bulb wherein a second arm of a magnetic circuit passes normally through the center of the bulb toroid, alternating voltage excitation being supplied to a first arm of the magnetic circuit; and an elliptical bulb that is disposed between oppositely facing ends of a two-part second magnetic arm that is similarly excited. In a further embodiment, an additional arm of the magnetic circuit serves to form a non-uniform field in the vicinity of the filament, thereby to provide a lift force against the force of gravity so as to minimize filament sagging.

U.S. Pat. No. 6,051,922

Inventor: Jakob Schlejen

Issued: Apr. 18, 2000

An electrodeless low-pressure mercury vapor discharge lamp includes a discharge vessel that gas-tightly encloses a discharge-space that is provided with a fill of mercury and a noble gas. The discharge vessel has a light-transmitting enveloping part and further has a sunken part in which a coil for generating a high-frequency magnetic field is arranged. At least a portion of a surface of the discharge vessel turned towards the discharge space is provided with a luminescent layer. At least a portion of the luminescent layer bears a protective layer of aluminum oxide particles with a covering weight of 10 to 500 .mu.g/cm.sup.2. The protective layer provides for a lower mercury consumption and/or a reduction in the change of color point during lamp life.

SUMMARY OF THE PRESENT INVENTION

The present invention discloses a remote powered electrodeless light bulb and an RF transmitter. The bulb requires no electrical connection and will not bum out, can be submerged into water without causing electrocution, is safe and non toxic and has many uses. The bulb may be of any size or shape, and is filled with inert argon gas and or other inert gases under vacuum. The transmitter emits an RF field from a distance of 1 to 25 feet and comprises a variable frequency adjustment knob, an output power field adjustment knob and a special effects transmitter knob for changing the pulse/strobe rate. Also shown is a power source, a base, which may be made of metal, a chassis ground wire, an antenna, and a transmitter housing. Clear or colored glass or plastic material of any shape or size form-the wall of the bulb and may be impregnated on its inner surface with fluorescent compound and argon gas and or multiple gases to produce color change at variable transmitter frequencies. A hook for hanging the bulb is also shown.

A primary object of the present invention is to provide a remote powered electrodeless light bulb.

Another object of the present invention is to provide an RF transmitter.

Yet another object of the present invention is to provide a bulb that requires no electrical connection.

Still yet another object of the present invention is to provide a bulb that will not burn out.

Yet another object of the present invention is to provide a bulb that can be submerged into water without causing electrocution to the user.

Yet another object of the present invention is to provide a bulb that can be of any size or shape and is filled with inert argon gas and or other inert gases under vacuum.

Additional objects of the present invention will appear as the description proceeds.

The present invention overcomes the shortcomings of the prior art by providing an RF transmitter and a remote powered electrodeless light bulb that requires no electrical connection and will not burn out. The remote powered electrodeless light bulb can be emerged into water without causing electrocution, is safe and non toxic and has unlimited uses, can be of any shape or size and is filled with inert argon gas and or other inert gases under vacuum.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention.

In the accompanying drawings, like reference characters designate the same or similar parts throughout the several views.

The following detailed description is, therefore, not to be taken in a limiting sense, and the scope of the present invention is best defined by the appended claim.

LIST OF REFERENCE NUMERALS

Figure 1:
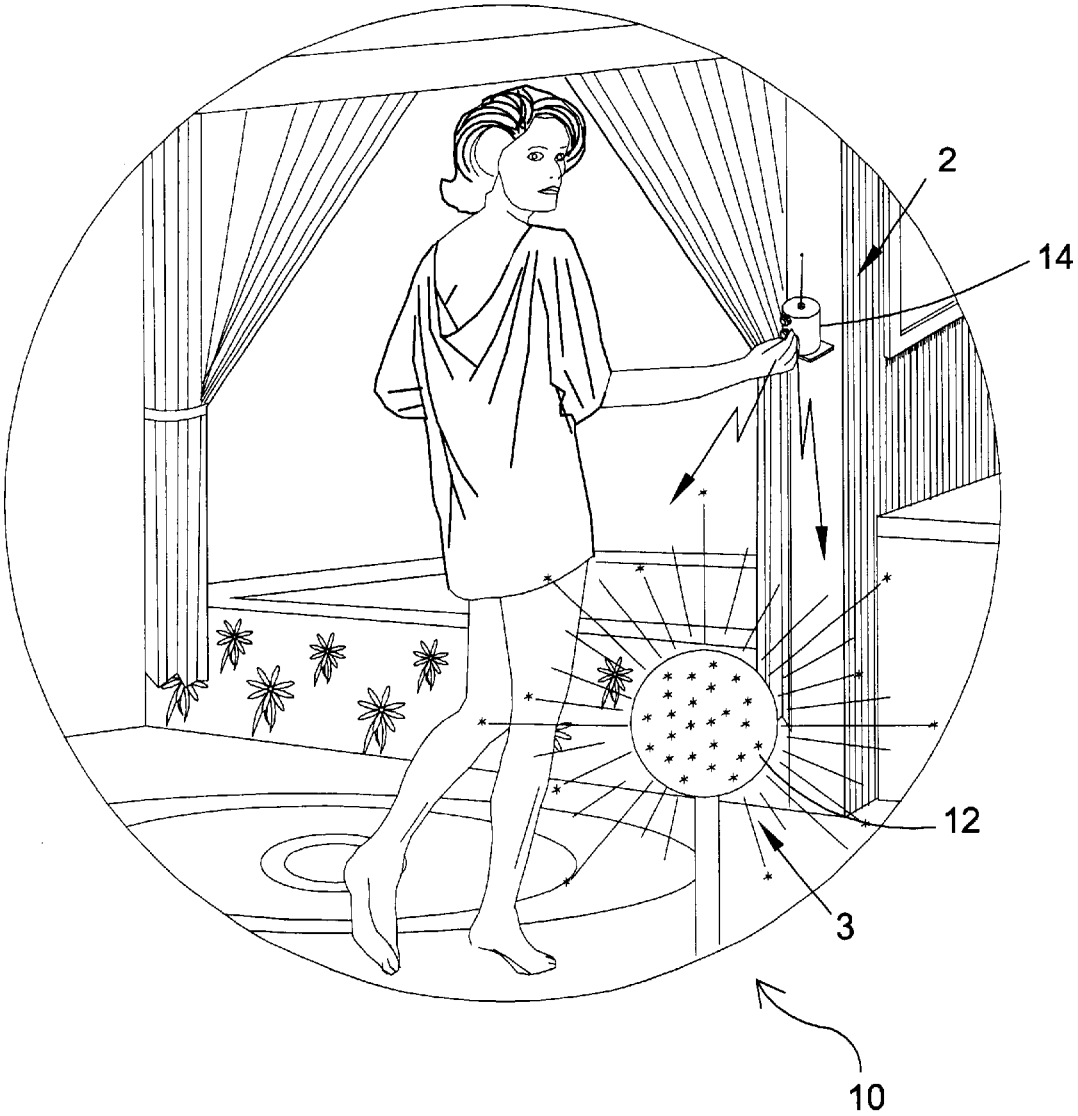
FIG. 1 is a perspective view of the present invention.

With regard to reference numerals used, the following numbering is used throughout the drawings.

10 present invention
12 electrodeless light bulb
14 RF transmitter
16 frequency adjustment knob
18 output power adjustment knob
20 special effects adjustment knob
22 power source
24 base
26 ground wire
28 antenna
30 transmitter housing
32 wall
34 fluorescent coating
36 argon gas
38 hook
40 RF wave field
42 excited gas
44 light
46 transmission field

48 room
50 connection for chassis ground

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to appended claims.

Turning to FIG. 1, shown therein is a perspective view of the present invention 10, a remote powered electrodeless light bulb 12 and an RF transmitter 14. The bulb 12 requires no electrical connection and will not burn out, can be submerged into water without causing electrocution, is safe and non toxic and has many uses. The bulb 12 may be of any size or shape, and is filled with inert argon gas and or other inert gases under vacuum.

Figure 2:
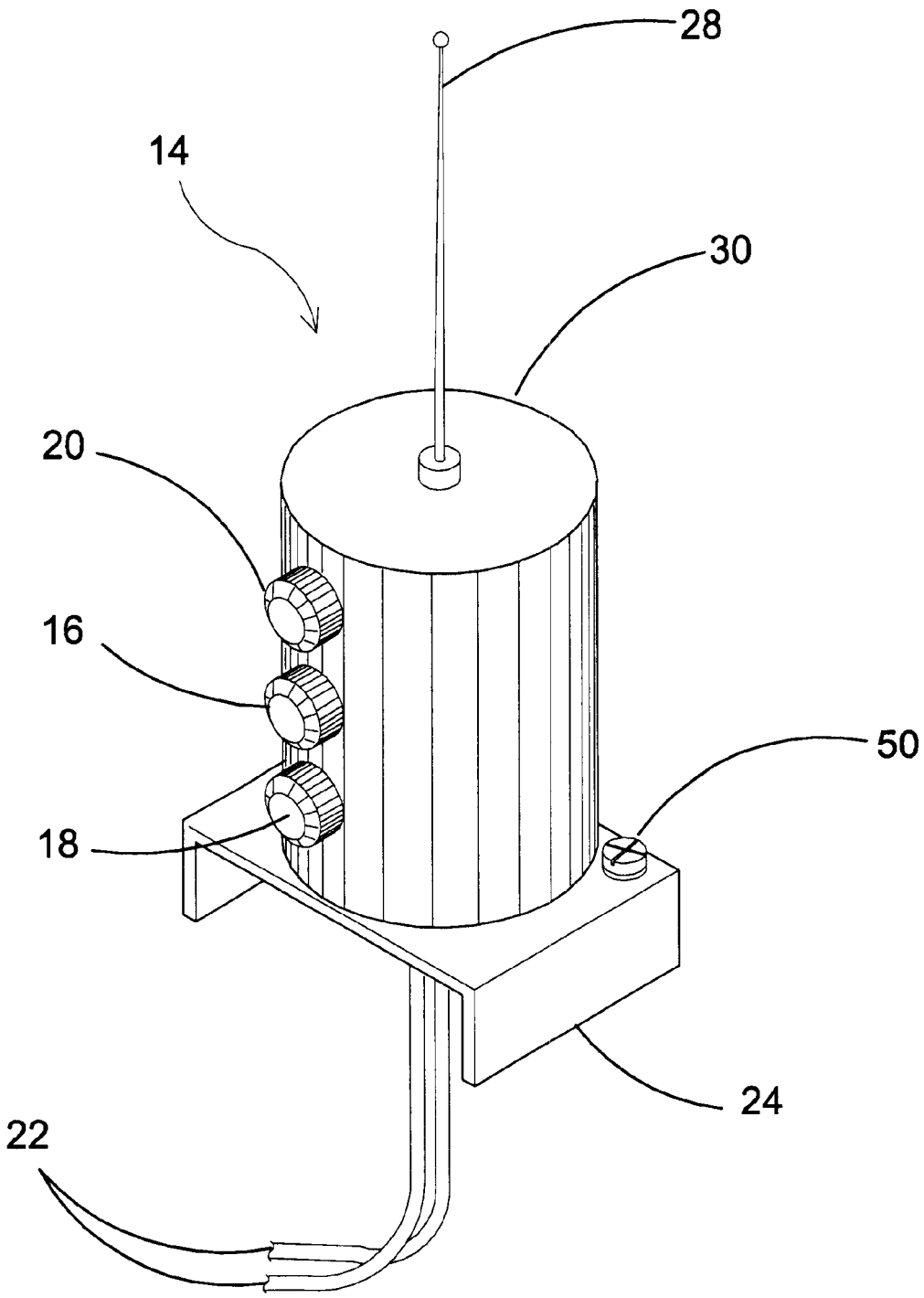
FIG. 2 is a perspective view of the transmitter of the present invention.

Turning to FIG. 2, shown therein is a perspective view of the transmitter 14 which emits an RF field from a distance of 1 to 25 feet. It comprises a variable frequency adjustment knob 16, an output power field adjustment knob 18 and a special effects transmitter knob 20 for changing the pulse/strobe rate. Also shown is a power source 22, a base 24, which may be made of metal, a chassis ground wire connector 50, an antenna 28, and a transmitter housing 30.

Figure 3:
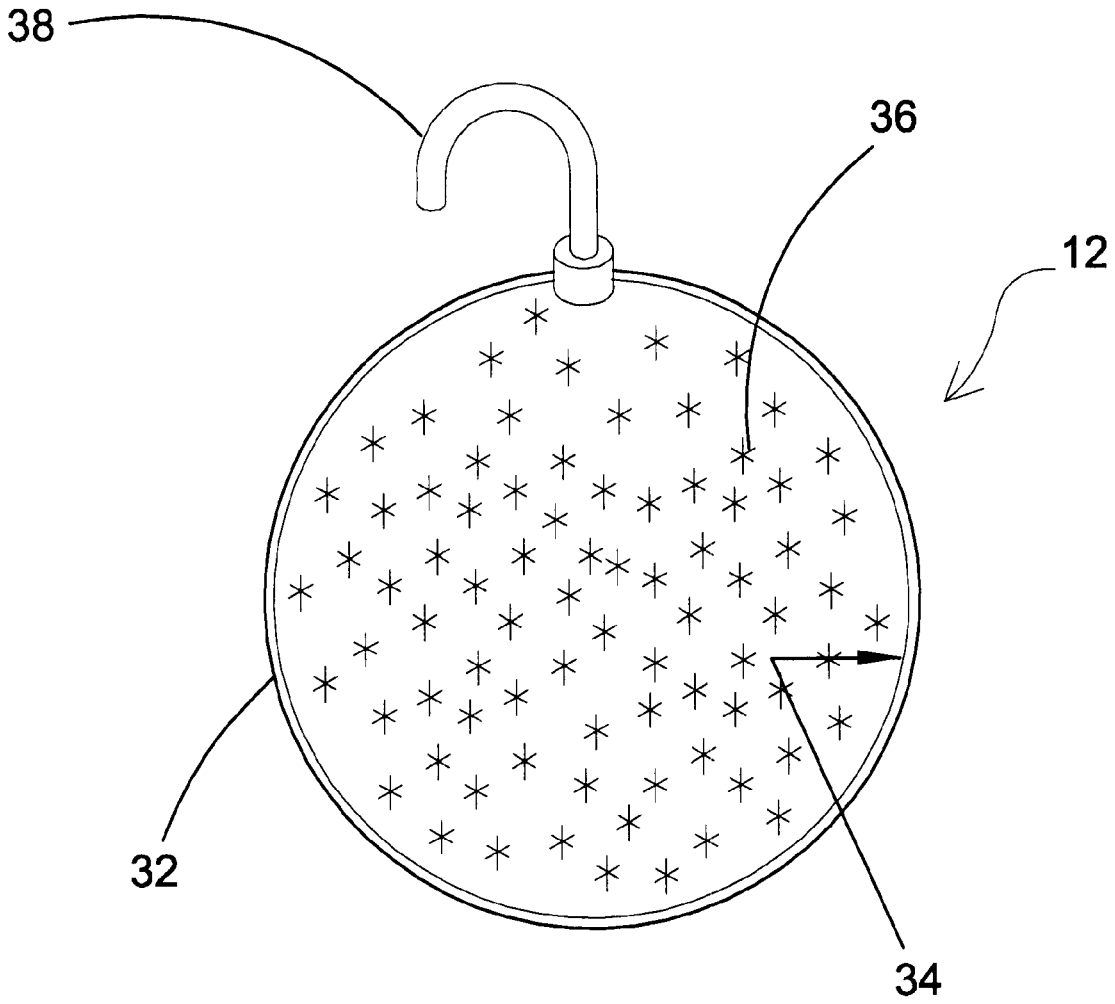
FIG. 3 is a perspective view of the electrodeless light bulb of the present invention.

Turning to FIG. 3, shown therein is a perspective view of the light bulb 12. Clear or colored glass or plastic 32 material of any shape or size form the wall of the bulb 12 and may be impregnated on its inner surface with fluorescent compound 34 and argon gas 36 and or multiple gases to produce color change at variable transmitter frequencies. A hook 38 for hanging the bulb 12 is also shown.

Figure 4:
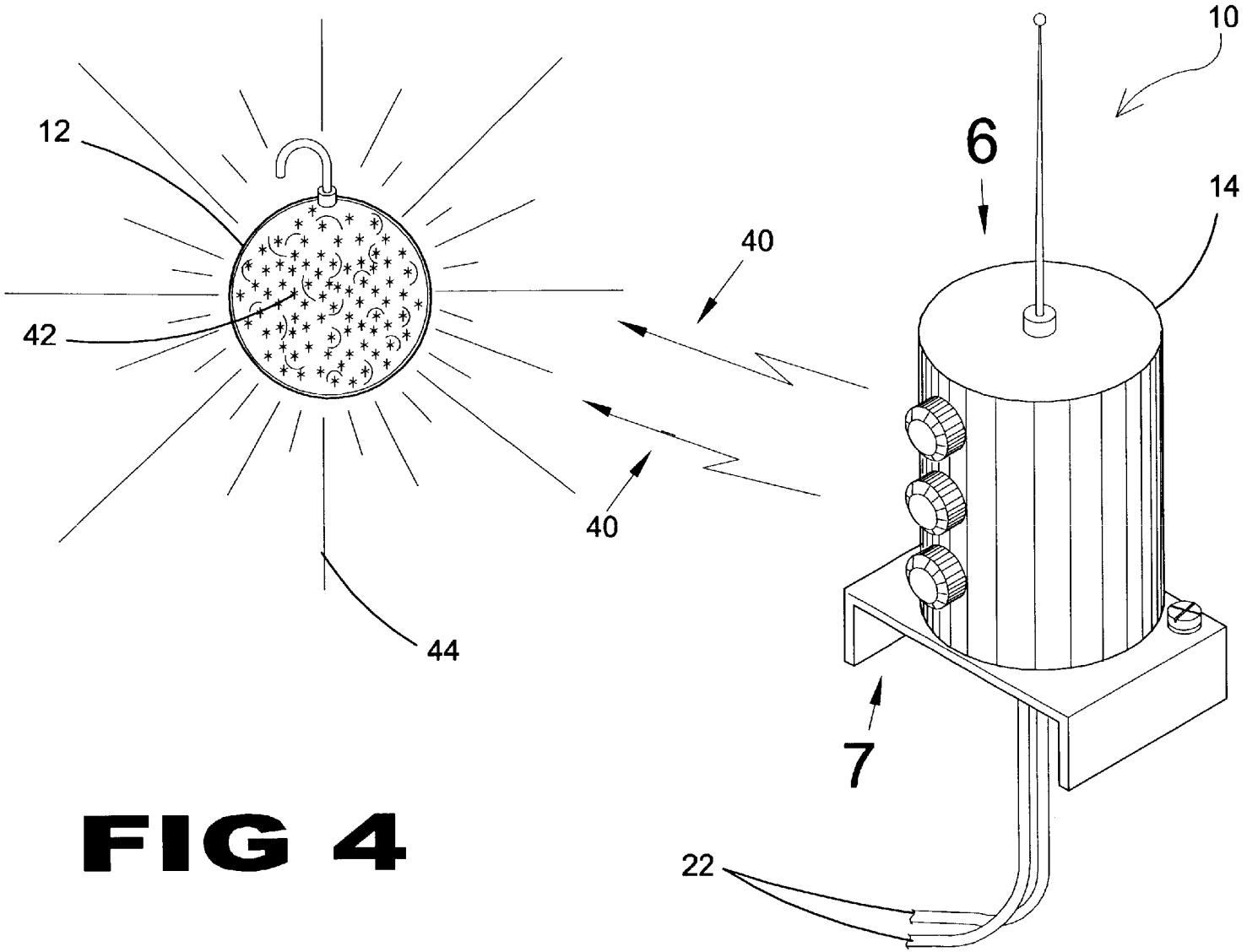
FIG. 4 is a perspective view of the present invention.

Turning to FIG. 4, shown therein is a perspective view of the present invention 10. The light bulb 12 requires no electrical connection. The bulb 12 is placed in proximity of the transmitter 14 RF wave field 40 and the inert gases become excited 42 in response to the RF field 40 to create ambient light 44. Power source 22 is also shown.

Figure 5:
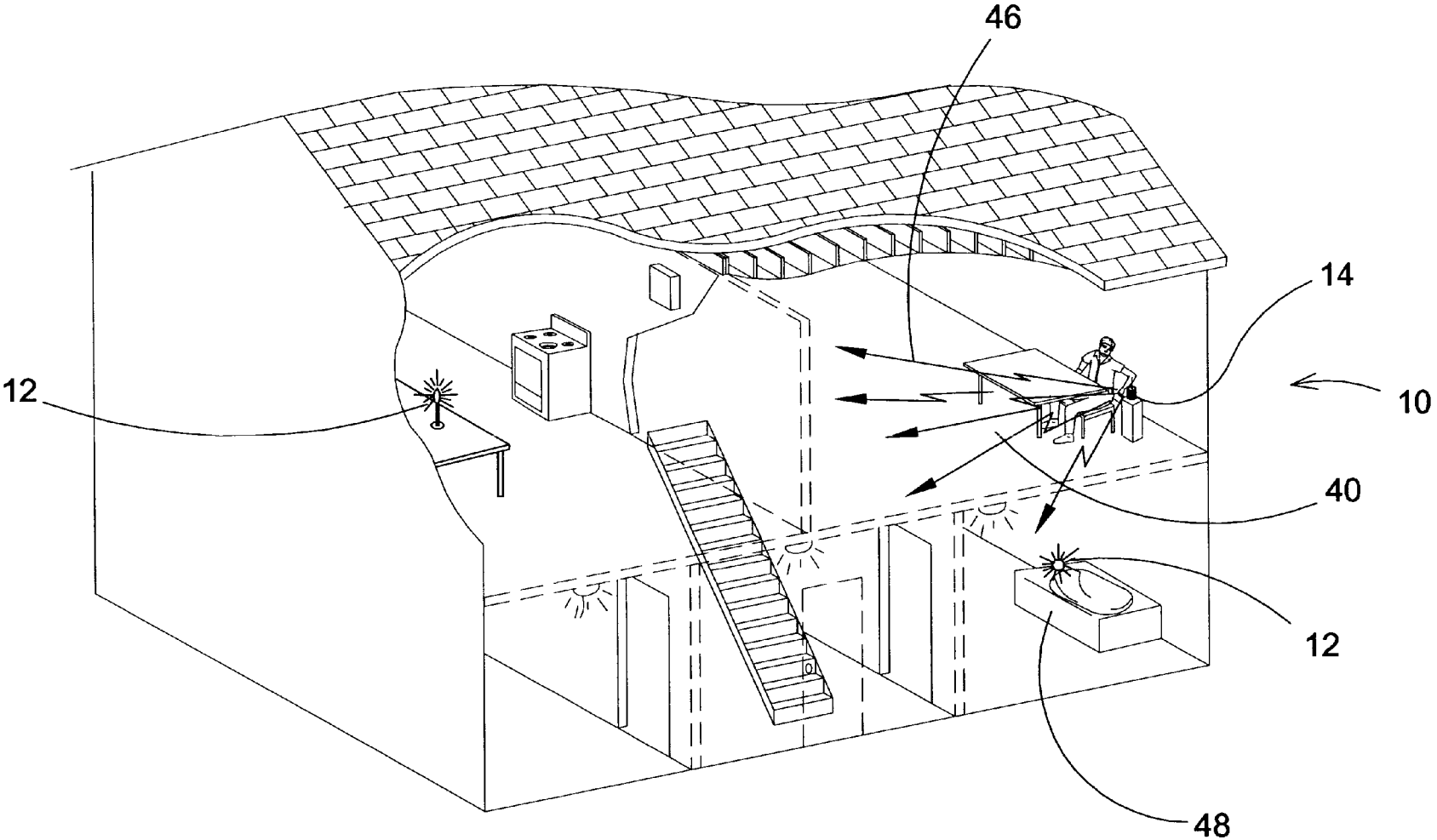
FIG. 5 is a perspective view of the present invention.

Turning to FIG. 5, shown therein is a perspective view of the present invention 10 in use being safe to use in any room 48 of a house. The light bulb 12 requires no electrical connection. The bulb 12 is placed in proximity of the transmitter 14 RF wave field 40 and the inert gases respond to the RF field to create ambient light. The transmitter 14 emits an RF field from a distance of 1 to 25 feet as shown at 46 and consists of a variable frequency adjustment knob, a power adjustment knob and a special effects transmitter knob as previously disclosed.

Figure 6:
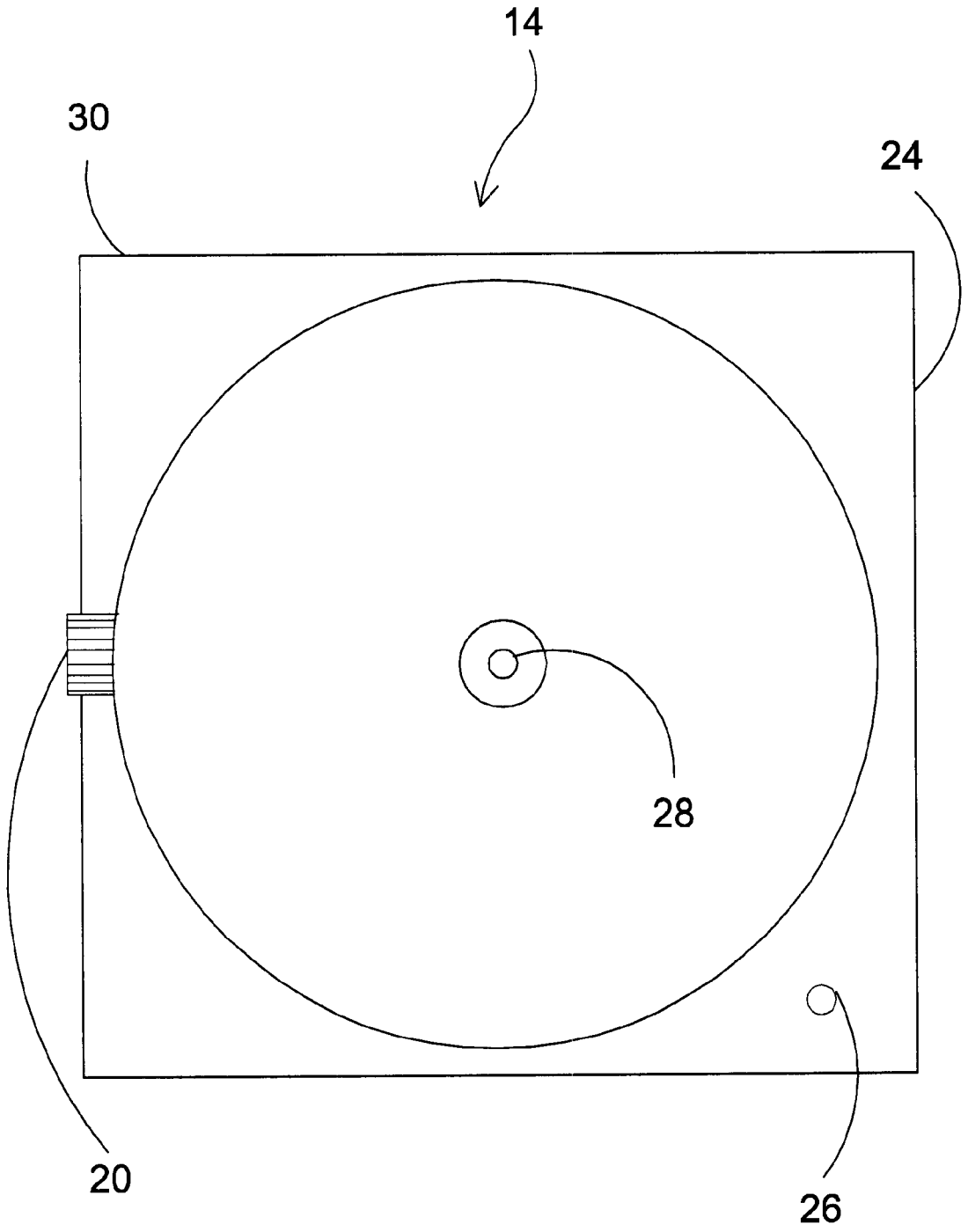
FIG. 6 is a top view of the transmitter.

Turning to FIG. 6, shown therein is a top view of the transmitter 14 showing elements which have been previously disclosed.

Figure 7:
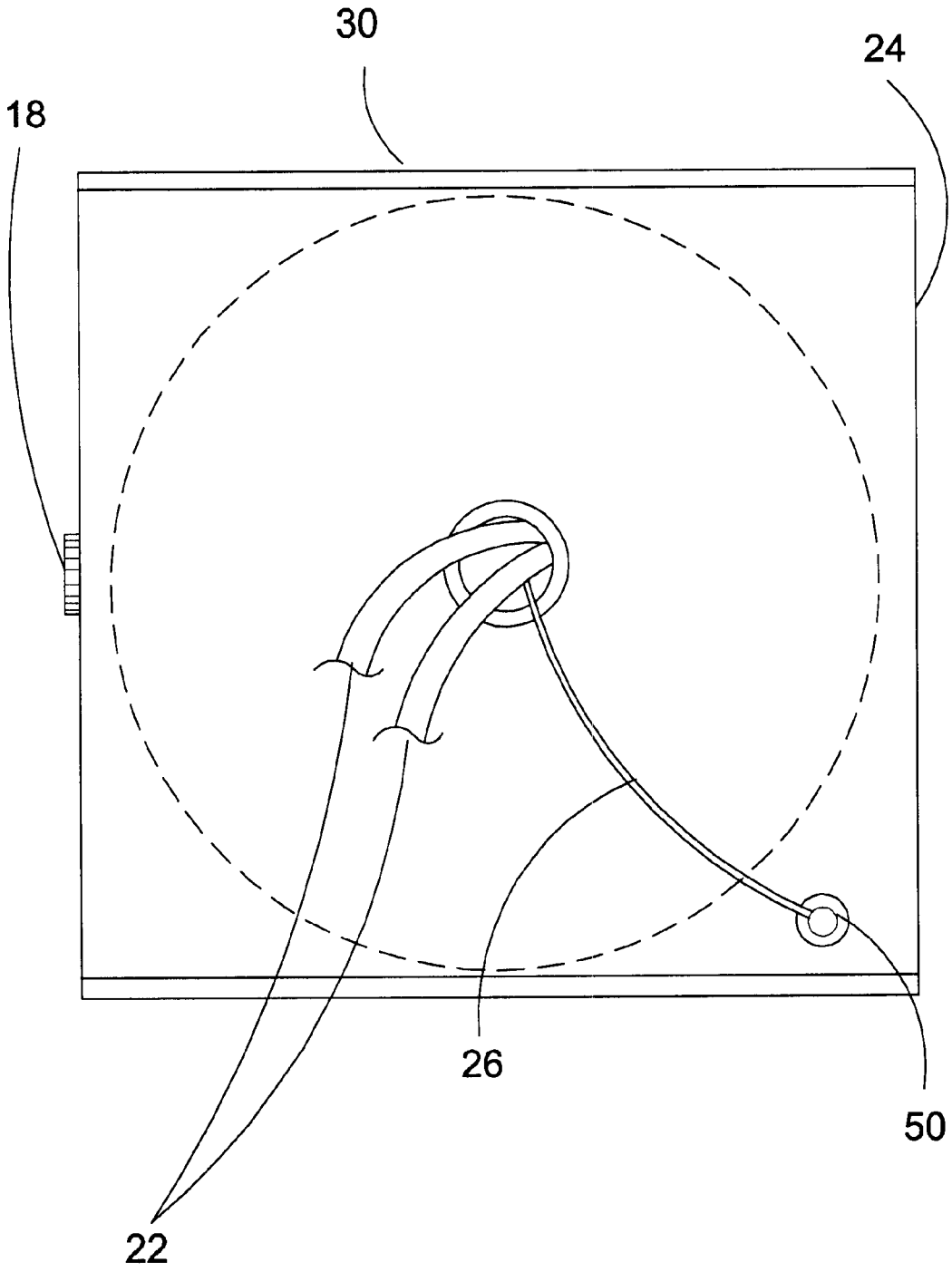
FIG. 7 is bottom view of the transmitter.

Turning to FIG. 7, shown therein is a bottom view of the transmitter 14 showing elements which have been previously disclosed.

Figure 8:
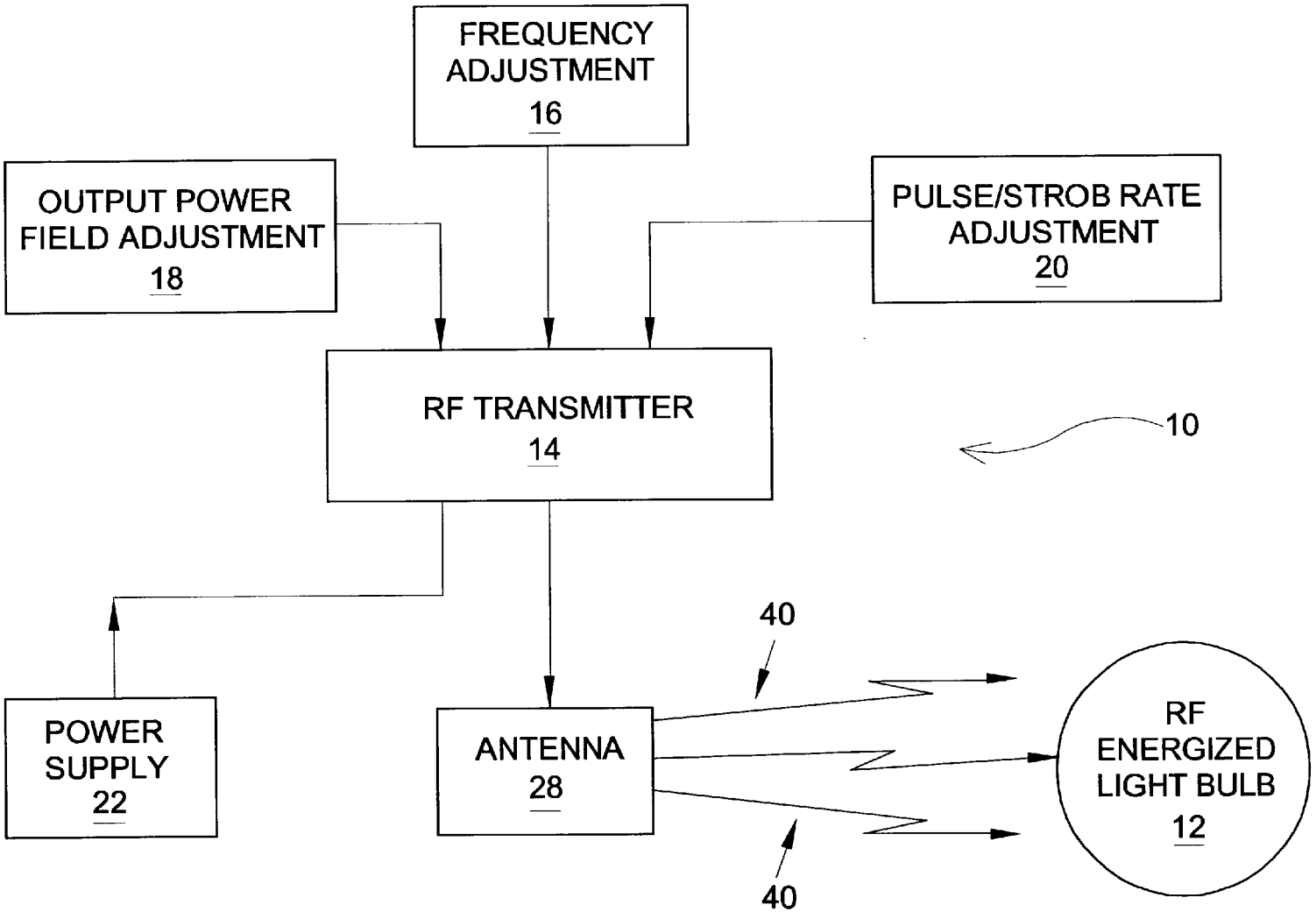
FIG. 8 is a flow chart of the function of the present invention.

Turning to FIG. 8, shown therein is a flow chart of the function of the present invention 10 showing elements which have been previously disclosed.

I claim:

1. An apparatus for an electrodeless light, comprising:

(a) a light bulb, said light bulb having an inner wall and an outer wall with a fluorescent coating disposed on said inner wall for producing a color change;

(b) an inert argon gas disposed internal said light bulb;

(c) a vacuum disposed internal said light bulb; and, (d) a radio frequency transmitter for exciting said inert gas comprising a radio frequency transmitter, a transmitter housing, a base, an antenna, a power source, a ground, and multiple controls for adjusting said radio frequency transmitter.

2. The apparatus of claim 1, wherein said light bulb further comprises a hook for hanging said light bulb.

3. The apparatus of claim 1, wherein said inert gas further comprises a mixture of inert gases.

4. The apparatus of claim 1, further comprising means for an output power field adjustment disposed on said radio frequency transmitter.

5. The apparatus of claim 4, further comprising means for a radio frequency adjustment disposed on said radio frequency transmitter.

6. The apparatus of claim 5, further comprising means for a pulse rate adjustment disposed on said radio frequency transmitter.

7. The apparatus of claim 6, wherein said radio frequency transmitter has a transmission range from about one foot to about 25 feet.

8. The apparatus of claim 7, wherein said light bulb is clear.

9. The apparatus of claim 7, wherein said light bulb is colored.

10. A method for an electrodeless light, comprising the steps of:

(a) forming a light bulb containing a vacuum;

(b) placing inert argon gas internal said light bulb and a fluorescent coating on an internal wall of said light bulb;

(c) exciting said inert gas by using a radio frequency transmitter and, (d) varying the output power field, radio frequency, and pulse rate of said transmitter.

11. The method of claim 10, further comprising the step of placing a mixture of inert gases including said argon gas internal said light bulb.

* * * * *